United States Patent [19]

Schlunke et al.

[11] Patent Number: 4,924,772

[45] Date of Patent: May 15, 1990

[54] CALENDER WITH INDIVIDUALLY SUPPORTED ROLLS AND CONSTANT NIP ALIGNMENT

[75] Inventors: Jürgen Schlunke, Krefeld; Franz Kaiser, Geldern; Hilmar Fenzau, Korschenbroich, all of Fed. Rep. of Germany

[73] Assignee: Kleinwefers GmbH, Krefeld, Fed. Rep. of Germany

[21] Appl. No.: 147,356

[22] Filed: Jan. 21, 1988

[30] Foreign Application Priority Data

Jan. 27, 1987 [DE] Fed. Rep. of Germany ..... 3702245

[51] Int. Cl.[5] ..... B30B 3/04

[52] U.S. Cl. ..... 100/163 R; 100/168; 100/170; 100/47

[58] Field of Search ..... 100/155 R, 161, 163 R, 100/164, 165, 166, 168, 169, 170, 171, 47, 158 R, 163 A; 28/134–139; 29/116.1; 72/232, 234, 243

[56] References Cited

U.S. PATENT DOCUMENTS

| | | | |
|---|---|---|---|
| 2,058,352 | 10/1936 | Putnam et al. | 100/170 |
| 3,016,819 | 1/1962 | Kupka | 100/163 R |
| 3,158,088 | 11/1964 | Seidel | 100/163 R |
| 3,199,442 | 8/1965 | Kuno et al. | 100/169 |
| 3,448,684 | 6/1969 | Cardinet et al. | 100/171 |
| 3,598,041 | 8/1971 | De Noyer | 100/163 A |
| 4,366,752 | 1/1983 | Koski | 100/168 |
| 4,510,859 | 4/1985 | Berry | 100/170 |
| 4,514,887 | 5/1985 | Rauf et al. | 100/170 |
| 4,635,861 | 1/1987 | Resch | 100/170 |
| 4,736,678 | 4/1988 | Stotz | 100/170 |

FOREIGN PATENT DOCUMENTS

| | | | |
|---|---|---|---|
| 2815966 | 11/1978 | Fed. Rep. of Germany | 100/171 |

*Primary Examiner*—Harvey C. Hornsby
*Assistant Examiner*—Joseph S. Machuga
*Attorney, Agent, or Firm*—Peter K. Kontler

[57] ABSTRACT

A calender wherein the intermediate rolls of a stack of rolls are mounted on pairs of levers pivotable on carriages which are movable up and down in vertical ways provided therefor in the frame. This renders it possible to change the levels of the intermediate rolls without any or without appreciable shifting of the centers of nips of neighboring rolls from a common vertical plane. The carriages are suspended on composite feed screws which can be rotated to move neighboring carriages nearer to or further away from each other.

25 Claims, 6 Drawing Sheets

CALENDER WITH INDIVIDUALLY SUPPORTED ROLLS AND CONSTANT NIP ALIGNMENT

BACKGROUND OF THE INVENTION

The invention relates to calendars in general, and more particularly to improvements in calendars of the type wherein the end portions of calendar rolls forming a stack of rolls are mounted in two frame members and at least one of the rolls is movable relative to the neighboring roll or rolls. Still more particularly, the invention relates to improvements in calendars of the type wherein at least one intermediate roll is mounted on a pair of levers which are pivotably as well as otherwise movably mounted in the respective frame members so as to reduce the likelihood of stray movements of the one intermediate roll with reference to the neighboring rolls in response to pivoting of the levers.

It is often desirable to mount the intermediate rolls of a calendar on pairs of levers because the bearings for the end portions of such rolls can be moved to different levels with a minimum of friction or with no friction at all, in contrast to intermediate rolls whose bearings are mounted directly on the respective frame members. As a rule, the pivots for levers which carry the bearings for the end portions of intermediate rolls are mounted directly in the frame members. Reference may be had to U.S. Pat. No 2,850,952 to Hornbostel. It is also known to provide compensators which bear upon the levers in directions to counteract the tendency of levers to pivot under the weight of the bearings which are mounted thereon. A drawback of such calendars is that the range of the compensators is small, in part because it is not advisable to pivot the levers through relatively large angles since this would entail a lateral shifting of the respective intermediate rolls with reference to the neighboring roll or rolls. In other words, if the levers which carry the bearings for the end portions of an intermediate roll in a stack of superimposed calendar rolls are pivoted through a relatively large angle, the nip of the intermediate roll with the neighboring roll or rolls is shifted horizontally and is out of line with the other nip or nips of the stack of rolls. On the other hand, it is often desirable or necessary to move the bearings for a particularly intermediate roll through a relatively large distance, for example, if a large-diameter intermediate roll is to be replaced with a smaller-diameter intermediate roll or vice versa. It is known that larger-diameter intermediate rolls (some of which are known as filled rolls) can be used jointly with smaller-diameter metallic rolls (e.g., steel rolls). Reference may be had, for example, to U.S. Pat. No. 3,016,819 to Kupka. In many calendars, the intermediate rolls include so-called soft or elastic rolls which are provided with peripheral linings of plastic, paper or other fibrous material and must be treated from time to time in material removing machines to restore the uniformity of their diameters.

The patent to Kupka further discloses a mechanism which can be used to reduce the extent of lateral shifting of an intermediate roll as a result of pivoting of levers which carry the bearings for the end portions of such roll. The mechanism employs short links with one end portion of each link articulately connected to an intermediate portion of the adjacent lever and the other end portion of each link fulcrumed in the frame. The pivots for the levers are fixedly mounted in the respective frame members, and each lever has a slotted portion which receives the respective pivot and is slidable therealong. The patent to Kupka further discloses rather complex means for limiting the extent of pivotability of levers for the bearings at the ends of intermediate levers; such limiting means includes a stop having an elongated slot and being pivotally mounted on a retaining lever which is movable to different levels by a feed screw. The patented calendar is rather complex and it cannot adequately limit the extent of lateral shifting of intermediate rolls in response to pivoting of the respective pairs of levers. In order to reduce the need for extensive pivoting of pairs of levers which carry the bearings for the intermediate rolls, the patent proposes to employ a fixedly mounted center roll, a first stack of intermediate rolls between the center roll and the topmost roll, and a second stack of intermediate rolls between the center roll and the lowermost roll. This patent does not propose to use compensators which would counteract the tendency of pairs of levers to pivot under the weight of the bearings for the end portions of intermediate rolls.

Austrian Pat. No. 284,611 discloses a calendar wherein some of the intermediate rolls are movable transversely of the neighboring rolls. The purpose of such adjustment is to compensate for wear upon the rolls.

OBJECTS AND SUMMARY OF THE INVENTION

An object of the invention is to provide a calendar wherein lateral shifting of lever-mounted intermediate rolls is reduced or eliminated in a novel and improved way.

Another object of the invention is to provide a simple, compact and relatively inexpensive calendar which employs novel and improved compensators for levers which carry the bearings for the end portions of intermediate rolls.

A further object of the invention is to provide the above outlined calendar with novel and improved means for movably securing the levers for the bearings of intermediate rolls to the frame.

An additional object of the invention is to provide novel and improved means for coordinating the movements of intermediate rolls relative to each other preparatory to or following replacement of one or more intermediate rolls.

An additional object of the invention is to provide a novel and improved method of counteracting the tendency of intermediate rolls to move sideways in response to pivoting of levers which carry the bearings for the end portions of such rolls.

Still another object of the invention is to provide a calendar whose operation can be automated to any desired extent and wherein the guide means for the running web or webs of treated material need not be mounted on separate supports.

A further object of the invention is to provide a calendar wherein the guide means for the running web or webs can be adjusted in automatic response to adjustment of intermediate rolls relative to each other and relative to the outer rolls.

The improved calendar comprises a frame and a stack of rolls in the frame. The stack includes two outer rolls and at least one intermediate roll having stub-shaped or otherwise configurated coaxial first and second end portions. The calendar further comprises first and second bearings for the respective end portions of the intermediate roll, first and second levers for the respective bearings, and novel and improved means for movably mounting the levers in the frame. The mounting means comprises first and second ways provided in the frame, first and second slides or carriages which are reciprocable along the respective ways, coaxial first and second pivot means which angularly movably connect the first and second levers to the respective carriages, and means for moving the carriages along the respective ways. The common axis of the pivot means is parallel to the axis of the intermediate roll, and the ways extend transversely of the common axis of the pivot means. As a rule, the common axis of the pivot means is substantially horizontal and the ways are or can be substantially vertical. The moving means preferably further comprises means for locating each of the carriages at any one of a plurality of different levels relative to the respective ways. The frame preferably comprises spaced-apart first and second upright frame members, and the ways preferably include parallel first and second guides provided in the respective frame members. Each guide can include a substantially vertical slot or groove in the respective frame member and the carriages can comprise portions which are non-rotatably and reciprocably installed in the respective guides.

The configuration of the frame members can be such that each of the levers can be provided with a bifurcated portion whose prongs flank the respective frame member. The arrangement is preferably such that each of these frame members has a side facing away from the respective bearing for the intermediate roll and the ways are provided at or actually in such sides of the respective frame members.

If the ways are substantially vertical, the moving means preferably includes means for maintaining the carriages in suspended positions. The maintaining means can comprise a support for each carriage, a holder connected to each carriage and substantially vertically movably coupled to the respective support, and means for moving the holders with reference to the respective supports to thereby raise or lower the intermediate roll.

The stack of rolls can comprise an additional intermediate roll beneath the one intermediate roll, and such calendar then further comprises additional bearings, levers and mounting means for the additional intermediate roll. The additional bearings, levers and mounting means are preferably identical with the bearings, levers and mounting means for the one intermediate roll. Each of the aforementioned holders can include a first threaded portion mating with the respective support and a second threaded portion mating with the first threaded portion of the holder beneath it. Thus, the second threaded portion of the holder for one carriage associated with the one intermediate roll constitutes a support for the first threaded portion of the adjacent holder for a carriage for a lever for a bearing for one end portion of the additional intermediate roll. The means for moving the holders includes means for rotating the holders for the one intermediate roll so as to raise or lower the one intermediate roll relative to the supports as well as relative to the additional intermediate roll.

The calendar preferably further comprises means for limiting the extent of pivotability of the levers with reference to the respective carriages. Such limiting means can comprise an arm which is provided on and is pivotable with at least one of the levers, and a stop which is provided on the respective carriage and is located in the path of pivotal movement of the arm.

Each of the levers for bearings which carry the end portions of the one intermediate roll can include a first portion (e.g., a discrete arm or a first part of a single arm) which supports the respective bearing and a second portion (such as a discrete second arm or a second part of the single arm) which is located opposite an extension of the respective carriage. Such calendar can further comprise compensator means disposed between the second portions of the levers and the respective extensions. The bearings and the one intermediate roll which is carried by the bearings tend to pivot the levers about the common axis of the pivot means in a predetermined direction (for example, under the action of gravity) and the compensating means includes means for applying to the second portions of the levers torque which acts upon the levers counter to the predetermined direction. The aforementioned means for limiting the extent of pivotability of the levers in or counter to the predetermined direction can constitute an integral or separable part of at least one of the compensating means.

At least one of the compensating means can comprise a fluid-operated motor (preferably a hydraulic motor). The motor can include a cylinder member, a piston member which is reciprocable in and defines with the cylinder member a cylinder chamber, a source of pressurized fluid, a vessel for spent fluid, and valve means for selectively connecting the cylinder chamber with the source of pressurized fluid or with the vessel. Such motor can further comprise first and second conduits each of which connects the cylinder chamber with the valve means. A flow restrictor means is provided in one of the conduits and the piston member is movable relative to the cylinder member and/or vice versa to thereby cause expulsion of fluid from the cylinder chamber under the action of the piston member. The movable member is movable between a plurality of first positions in each of which the piston member permits the fluid to leave the cylinder chamber by way of the other conduit and a plurality of second positions in each of which the piston member at least partially blocks the flow of fluid through the other conduit so that the fluid which is to be expelled from the cylinder chamber must pass through the one conduit and hence through the flow restrictor means.

The cylinder member and the piston member can define a second cylinder chamber, and the motor can further comprise a second source of pressurized fluid which is connected with the second cylinder chamber and wherein the pressure of fluid is lower than in the first mentioned source. Accumulator means can be connected with each source to reduce the likelihood of abrupt changes of pressure of fluid which is being admitted into the one or the other cylinder chamber.

The rolls which form the stack define at least two nips for a running web of paper, textile material or the like. In accordance with a feature of the invention, a web guide (e.g., an idler roller) can be mounted on the levers at one side of the one intermediate roll.

One of the outer rolls is preferably located above and the other outer roll is preferably located below the intermediate roll or rolls. The end portions of the one outer roll are preferably rotatable in bearings which are affixed directly to the frame. The aforementioned supports of the mounting means (and more specifically of the suspending means for the carriages) are or can be fixedly mounted in the frame.

The bearings for the end portions of the other outer roll can be moved up and down by fluid-operated motors, and such motors are preferably provided with means for rapidly lowering the respective bearings in order to rapidly increase the distance between the two outer rolls. Such means for rapidly lowering can include valve means and the calendar can further comprise means for simultaneously operating the valve means of the motors for the bearings which support the end portions of the other outer roll as well as the valve means for the aforediscussed cylinder chamber.

At least one of the outer rolls can comprise a fixedly mounted carrier (e.g., a shaft which is non-rotatably mounted in the frame), a sleeve which is rotatable around the carrier, and means (such as one or more sets of hydrostatic bearing elements operating between the carrier and the shell) for selectively deforming portions of the shell in order to regulate the pressure upon the running web and/or to regulate the width of the nip between such outer roll and the neighboring intermediate roll.

The novel features which are considered as characteristic of the invention are set forth in particular in the appended claims. The improved calendar itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
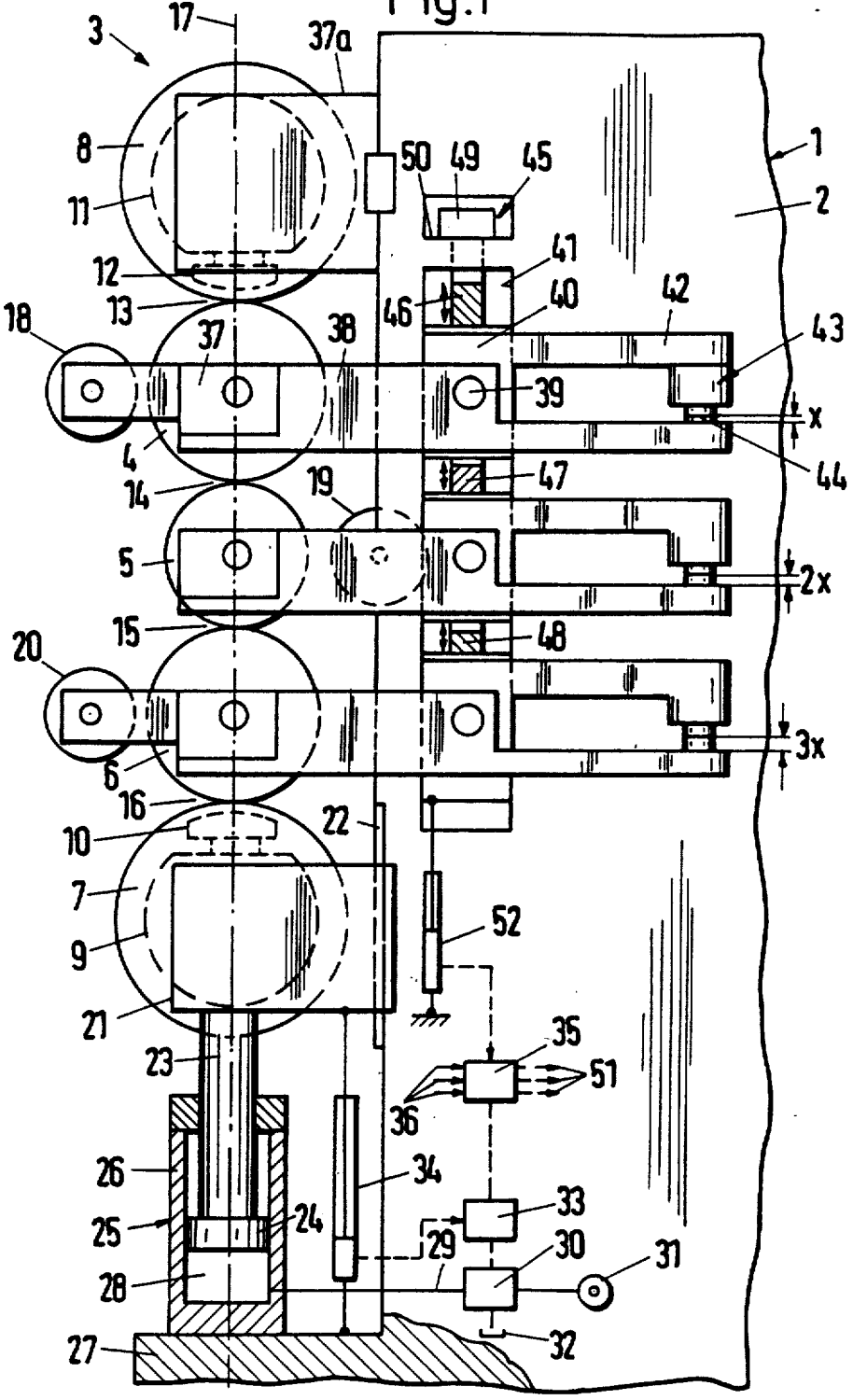
FIG. 1 is a fragmentary schematic side elevational view of a calendar with three intermediate rolls which are mounted and are adjustable in accordance with one embodiment of the present invention, the rolls being shown in operative positions.
Figure 2:
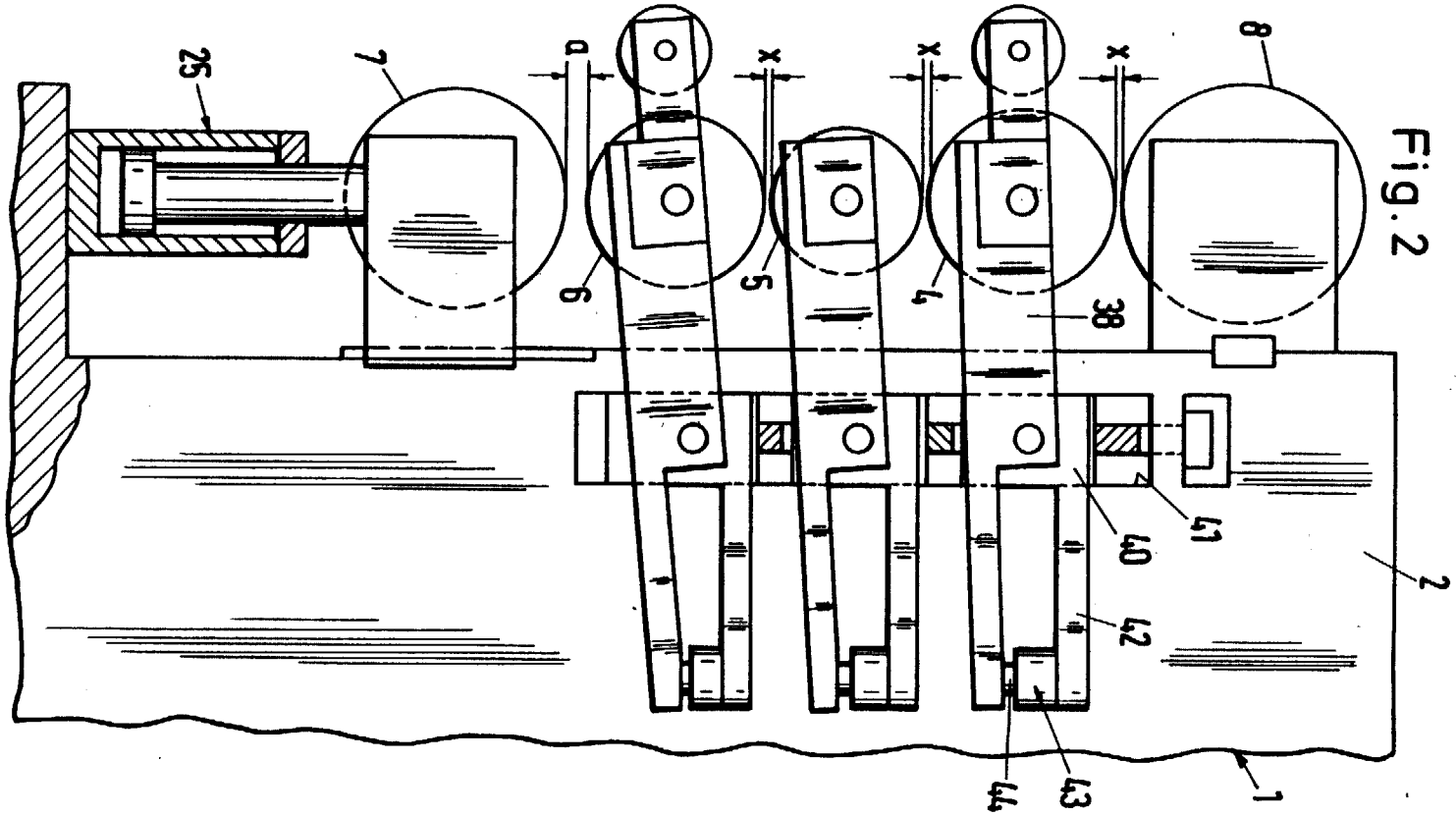
FIG. 2 illustrates a portion of the calendar with the rolls spaced apart from one another preparatory or subsequent to removal of a roll.
Figure 3:
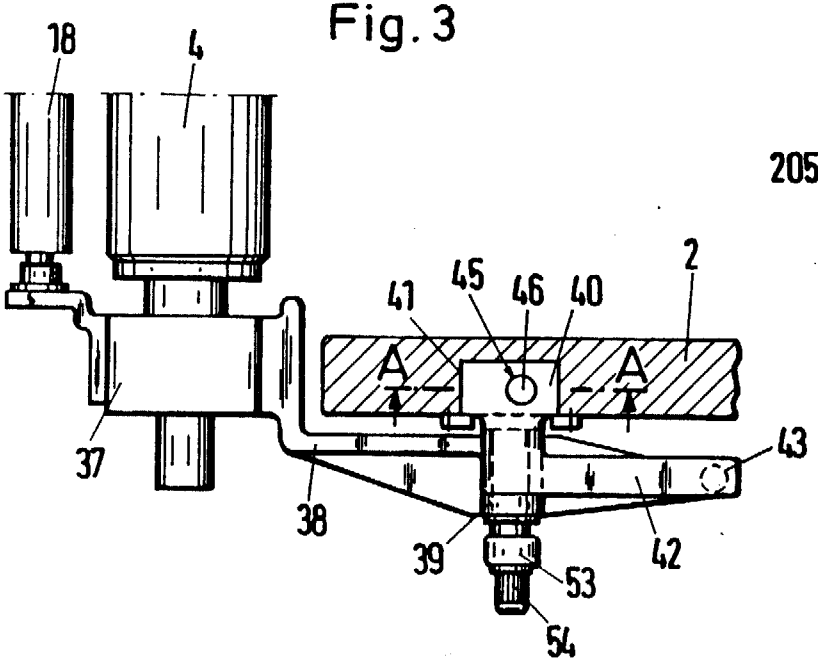
FIG. 3 is an enlarged fragmentary horizontal sectional view taken at the level of the nip of topmost roll with the neighboring intermediate roll and shows the manner in which one of the carriages is slidably confined in its ways.

FIGS. 1 to 3 show a portion of a calendar which embodies one form of the present invention and comprises a frame 1 having two spaced-apart upright frame members 2 (only one shown). The frame members 2 support a stack 3 of calendar rolls including two outer rolls 7, 8 and three intermediate rolls 4, 5 and 6. The diameters of the intermediate rolls 4, 6 (also called filled rolls) exceed the diameter of the intermediate roll 5 whose shell can be made of metal. It is assumed that the shells of the rolls 4, 6 are made of an elastic material and must be treated from time to time in a suitable material removing machine in a manner well known from the art of calendars and not forming part of the present invention.

The lowermost roll 7, also called king roll, has a hollow cylindrical shell which is or can be made of steel and is rotatable around a fixedly mounted horizontal carrier 9. Hydrostatic bearing elements 10 are interposed between the shell of the king roll 7 and the carrier 9, and such hydrostatic bearing elements can receive a pressurized hydraulic fluid in order to deform selected portions of the shell of the roll 7 in a manner which is well known from the art and is disclosed in numerous United States and foreign patents of the assignee of the present application. The illustrated hydrostatic bearing elements 10 constitute but one form of means which can be employed to selectively deform certain portions of the shell of the roll 7 so as to regulate the width of the nip 16 of the rolls 6, 7 and to thereby influence the characteristics of a running web of paper or other flexible material which is being treated in the calendar.

The topmost roll 8 (also called queen roll) also comprises a fixedly mounted carrier 11 and a hollow cylindrical shell of steel or other suitable material with at least one row of hydrostatic bearing elements 12 between the carrier 11 and the shell to allow for selective deformation of certain portions of the shell and to thus regulate the width of the nip 13 of the rolls 4 and 8. Two additional nips 14 and 15 are defined by the steel roll 5 with the filled rolls 4 and 6, respectively.

In accordance with a feature of the invention, each of the nips 13 to 16 has two halves which are mirror symmetrical to each other with reference to a vertical plane 17 (indicated in FIG. 1 by a phantom line). The plane 17 includes or is immediately adjacent the axes of the rolls 4–8 in spite of the fact that each end portion of each of the intermediate rolls 4–6 is mounted at one end of a pivotable lever 38. In the absence of any undertakings to the contrary, the axis of the roll 4, 5 or 6 would be shifted to the right or to the left in response to pivoting of the respective pair of levers 38 about the axes of their pivot means 39. This would affect the quality of the web which is treated in the calendar while passing through the nip 13, around a first guide roller 18, through the nip 14, around a second guide roller 19, through the nip 15, around a third guide roller 20, and through the nip 16.

The end portions of the carrier 9 for the hollow cylindrical shell of the king roll 7 are mounted in two bearings 21 each of which is movable up and down along vertical guide means 22 provided therefor on the respective frame member 2. The means for moving the two bearings 21 up and down in exact synchronism so as to raise or lower the carrier 9 without changing its orientation comprises two fluid-operated motors 25 only one of which is shown in the drawing. Each of the motors 25 comprises an upright cylinder 26 which is mounted on a foot or base 27 of the frame 1 and contains a reciprocable piston 24. The piston rod 23 of the piston 24 is affixed to the respective bearing 21. The cylinder chamber 28 beneath the piston 24 in the cylinder 26 can receive pressurized fluid (e.g., oil) from a source 31 (e.g., a pump) by way of a conduit 29 which contains a system of valves 30. The reference character 32 denotes a vessel which receives spent fluid from the chamber 28 when the motor 25 is to cause or permit rapid downward movement of the respective bearing 21, e.g., for the purpose of permitting convenient replacement of the roll 7, of the roll 8 or of one of the intermediate rolls 4 to 6. The maximum upward stroke of the piston 24 is selected in such a way that the neighboring rolls 4–8 of the stack 3 can actually contact each other even after the diameters of the filled rolls 4 and 6 are reduced to a minimum permissible value. By the same token, the piston 26 should be capable of assuming a lower end position in which it allows for adequate separation of all five rolls, even when the stack 3 contains two fresh (maximum-diameter) filled rolls (4 and 6).

The system of valves 30 is or can be identical with that disclosed in German Pat. No. 28 45 055. The valves of the system 30 are designed to abruptly lower the king roll 7 in the event of malfunction by permitting the fluid medium to flow from the cylinder chamber 28 into the vessel 32 at a high rate while the chamber 28 is disconnected from the pressure side of the source 31. The latter can be designed to draw fluid from the vessel 32. The arrangement is preferably such that, when the system of valves 30 is actuated, the initial stage of lowering the king roll 7 is completed within a very short interval of time and valves thereupon begin to throttle the flow of fluid from the chamber 28 so that the rate of lowering the roll 7 is gradually decelerated down to a full stop.

The system of valves 30 is controlled by a control unit or regulator 33 having a first input connected to the output of a level monitoring device 34 for the king roll 7 (e.g., for the piston 24 in the cylinder 26 of the motor 25) and a second input connected to a source 35 of reference signals (e.g., a suitable computer). The level monitoring device 34 is of known design; it can include a proximity detector or an ultrasonic distance measuring instrument. The computer 35 transmits to the regulator 33 reference signals which are compared with the signal from the monitoring device 34, and the regulator 33 causes the system of valves 30 to change the level of the piston 24 and king roll 7 if such level deviates from the desired level. The computer 35 has several inputs 36 which serve to receive all relevant data for proper operation of the calendar. Certain additional functions of the computer 35 will be explained hereinafter.

The other bearing 21 for the carrier 9 of the king roll 7 is movable up and down by a second motor 25. However, a single system of valves 30 can control the flow of fluid into and from the cylinder chambers 28 of both motors 25.

The bearings 37*a* for the end portions of the carrier 11 forming part of the queen roll 8 are mounted directly on the respective frame members 2.

Figure 6:
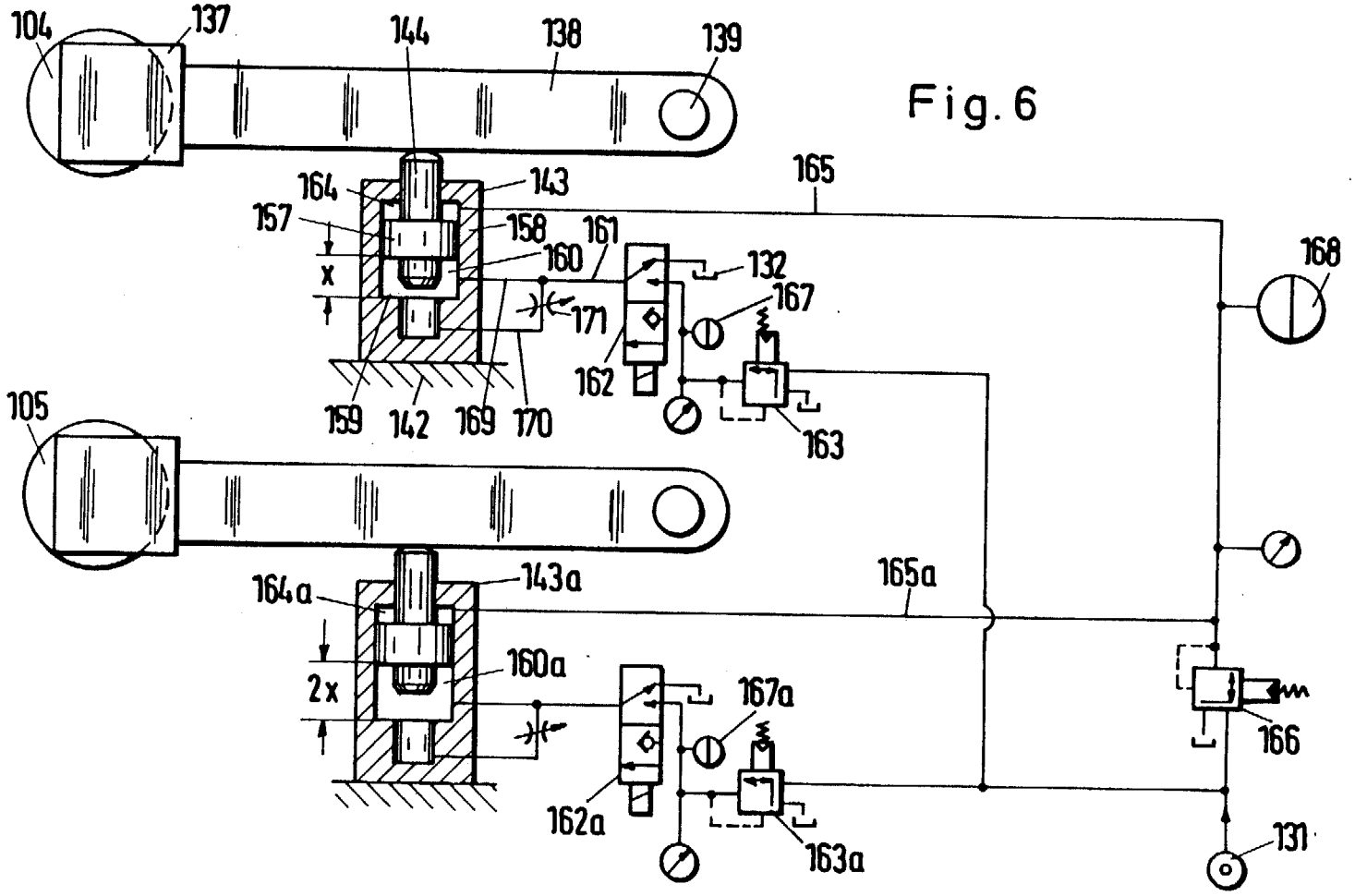
FIG. 6 is a schematic fragmentary side elevational view of a portion of a calendar which is similar to that of FIG. 4, and further showing two compensators and the associated controls.

The levers 38 which carry the bearings 37 for the end portions of the intermediate roll 4 are pivotable about the common axis of the respective pivot means 39, and such pivot means are mounted in slides or carriages 40 each movable up and down in ways 41 of the respective frame member 2. The illustrated ways 41 are vertical slots or grooves which are provided in the respective frame members 2, and the configuration of at least a portion of each carriage 40 is such that it can slide up and down but cannot turn in the respective ways 41 (see particularly FIG. 3). Each carriage 40 has an extension 42 which extends in a direction away from the respective bearing 37 and cooperates with a compensator 43 having a piston rod 44 which can apply to an arm of the lever 38 torque in a clockwise direction, as seen in FIG. 1, i.e., counter to the direction in which the lever 38 tends to pivot under the combined weight of the bearings 37 and intermediate roll 4. Each lever 38 is a two-armed lever one arm of which carries the respective bearing 37 and the other arm of which cooperates with the piston rod 44 of the respective compensator 43. The details of two compensators which can be employed in the calendar of the present invention are shown in FIG. 6. Each compensator 43 is a fluid-operated motor, preferably a hydraulic motor, and the purpose of the compensators 43 for the intermediate roll 4 is to ensure that the bearings 37 for the roll 4 (and/or the guide roller 18 mounted on the levers 38 for the bearings 37 which carry the end portions of the roll 4) have no influence upon bending or flexing of the roll 4. Otherwise stated, those end portions of the roll 4 which extend beyond the actual nips 13, 14, as well as the bearings 37 on such end portions and the left-hand arms of the respective levers 38 (together with the guide roller 18) should not adversely influence the shape of the central part of the roll 4 which is in contact with the running web in the nips 13 and 14.

The compensators 43 are provided with stops which serve to limit the extent of pivotability of levers 38 for the intermediate roll 4 in such a way that the maximum gap between the compensators 43 on the extensions 42 of the carriages 40 and the adjacent arms of the levers 38 for the roll 4 cannot exceed the value x. The compensators on the extensions 42 of the carriages for the intermediate rolls 5, 6 are provided with stops which limit the pivotability of the respective levers to the values 2x and 3x, respectively. The manner in which the intermediate rolls 5, 6 are mounted on their respective pairs of levers 38 and the manner in which these levers are pivotally mounted on the respective carriages is the same as described in connection with the manner of mounting the roll 4.

The means for movably mounting the carriages 40 for the levers 38 which support the bearings 37 for the intermediate roll 4 includes two suspending devices 45 each having a support or head 49 in an aperture 50 of the respective frame member 2, a holder 46 for the respective carriage 40, and means for moving the holder 46 and the respective carriage 40 along the corresponding ways 41. Each suspending device 45 further comprises a holder 47 for a carriage 40*a* (FIG. 7) associated with the roll 5 and a holder 48 for a carriage associated with the roll 6. Each of the holders 46, 47, 48 can move the respective carriage up or down, i.e., toward or away from the head 49. The latter serves as a support for the holder 46, a portion of the holder 46 serves as a support for the holder 47, and a portion of the holder 47 serves as a support for the holder 48. The illustrated support 49 is non-rotatably mounted in the respective frame member 2. Each of the holders 46, 47, 48 has two first and second threaded portions which threads are inclined in opposite directions so that, when the holder 46 is rotated, it moves nearer to the support 49 and nearer to the holder 46 or it moves away from the support 49 and away from the holder 47. The same holds true for the holders 47 and 48, i.e., the holder 47 can be rotated to move closer to or further away from the neighboring holders 46, 48, and the holder 48 can be rotated to move nearer to or away from the holder 47 and the lower end of the respective ways 41.

The computer 35 has outputs 51 for transmission of signals which are used to select the level of the carriages 40 for the levers 38 which carry the intermediate rolls 4 and 6. An input of the computer 35 is connected with the output of a level monitoring device 52 for the lowermost carriages in the ways 41. The monitoring device 52 can operate with ultrasound, the same as the level monitoring device 34.

If one of the intermediate rolls 4 to 6 must be replaced with a fresh roll or with a roll having a different diameter (which can be larger or smaller than the diameter of the roll necessitating replacement), one or more inputs 36 of the computer 35 receive appropriate information so that the computer can calculate the optimum level for the carriages 40 which support the respective levers 38 (namely the levers for the bearings 37 of the roll which is to be installed in lieu of one of the rolls 4–6). The computer 35 can also generate signals which denote the required or optimum levels of the other pairs of carriages. The thus generated signals appear at the outputs 51 and are used to carry out the necessary adjustments. This will be described with reference to FIG. 7.

Since the guide rollers 18, 19 and 20 are respectively mounted between the pairs of levers 38 for the intermediate rolls 4, 5 and 6, their levels are adjusted in automatic response to signals at the outputs 51 of the computer 35 so that the tensioning of the web which is trained over the guide rolls 18–20 and passes through the nips 13–16 does not change in the course of the roll exchanging operation.

In normal operation, the rolls 4–8 of the stack 3 are maintained in positions (i.e., at levels) which are shown in FIG. 1. If a defective portion of the running web reaches the calendar or the rolls 4–8 of the calendar must be arrested for any other reason, the motors 25 are actuated to cause or allow a downward movement of the bearings 21 for the end portions of the carrier 9 forming part of the king roll 7. The weight of each intermediate roll then causes the respective pair of levers 38 to pivot in a counterclockwise direction (as seen in FIG. 1) so that the intermediate rolls assume the positions which are shown in FIG. 2 (at distances x from one another) while the distance a between the rolls 6 and 7 equals the difference between the distance covered by the bearings 21 toward the base 27 and 3x. The distance a can vary within a reasonably wide range, depending on the selected difference between the normal level of the king roll 7 and the level of this roll upon completion of actuation of the motors 25 in a sense to initiate or cause a lowering of the bearings 21.

In order to thereupon replace a selected intermediate roll 4, 5 or 6, one of the computer inputs 36 receives a signal denoting the diameter of the roll which is to replace one of the rolls 4–6. The computer 35 transmits one or more signals which initiate a vertical movement of the carriages for levers 38 which are to support the fresh roll so that the exact level of the roll to be installed in the calendar is determined in advance. If necessary, the computer 35 also transmits signals which are used to adjust the level of one or more additional pairs of carriages in their ways 41. For example, if the roll 5 necessitates replacement, it might be necessary to adjust the carriages 40*a* for the freshly inserted roll as well as the carriages for the roll 6 below the freshly inserted roll. It is preferred to change the levels of one or more pairs of carriages after the width of clearances between neighboring rolls of the stack 3 is reduced to zero because, at such time, the tilting stresses upon the carriages 40 and the tendency of the carriages to lie askew in the respective ways 41 is less pronounced than when the rolls of the stack 3 are separated from each other by gaps. As a rule, the level or levels of one or more pairs of carriages will be adjusted prior to replacement of a roll with a fresh roll if the diameter of the fresh roll exceeds the diameter of the replaced roll. The level or levels of the carriages are or can be adjusted subsequent to installation of a fresh roll if the diameter of the fresh roll is smaller than that of the replaced roll.

FIG. 3 shows a portion of one frame member 2, portions of the roll 4 and roller 18, one of the bearings 37 for the end portions of the roll 4, one of the levers 38 which carry the roll 4 and roller 18, one of the carriages 40 in its ways 41, one of the pivot means 39 (such pivot means is a hollow cylinder), the extension 42 of the carriage 40, and (by broken lines) the compensator 43 between the extension 42 and the adjacent arm of the lever 38. A drive shaft 53 which extends through the hollow pivot means 39 constitutes one element of the means for rotating the holder 46 for the carriage 40 (see also FIG. 7), and the reference character 54 denotes a reversible motor which can turn the shaft 53 clockwise or counterclockwise, depending upon whether the carriage 40 of FIG. 3 is to rise or descend in its ways 41. The motor 54 can constitute a pulse-operated stepping motor. Each pulse which is transmitted to the motor 54 results in an incremental angular movement of the shaft 53 such as is required to raise or lower the holder 46 through a unit distance. The computer 35 includes counter means for the just discussed pulses so that the exact level of the holder 46 is memorized in the computer at each stage of adjustment of the level of the carriage 40 along its ways 41.

Figure 7:
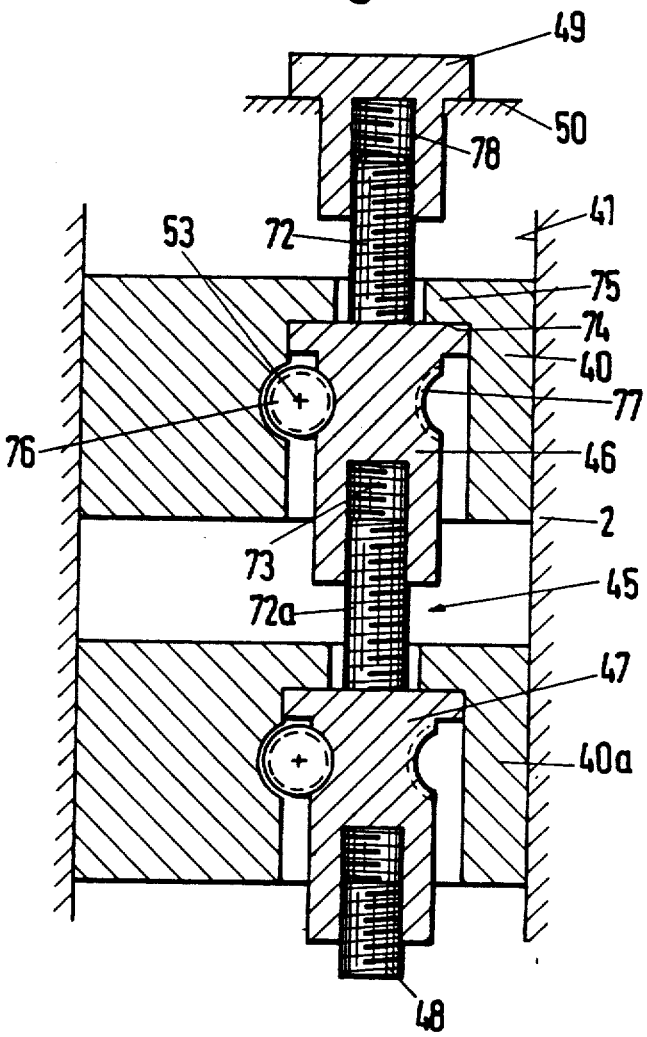
FIG. 7 is an enlarged fragmentary vertical sectional view as seen in the direction of arrows from the line A—A of FIG. 3 and shows certain details of two holders forming part of one of the suspending devices in the calendar of FIGS. 1 to 3.

FIG. 7 illustrates in greater detail the construction of a portion of one of the two suspending devices 45 which can move the carriages along the respective ways 41 and which can also locate and hold the carriages in selected positions, i.e., at selected levels. The holder 46 for the carriage 40 which is shown in FIG. 7 has a first or upper portion 72 which is provided with external threads and mates with an internally threaded portion 78 of the support 49. As explained hereinbefore, the support 49 is non-rotatably installed in an aperture 50 of the respective frame member 2. An internally threaded lower portion 73 of the holder 46 for the carriage 40 is in mesh with the externally threaded upper portion 72*a* of the holder 47 for the carriage 40*a* beneath the carriage 40. The carriage 40*a* is one of two carriages which support the pivot means for the levers 38 which carry the intermediate roll 5. The lower portion 73 of the holder 46 constitutes a support for the upper portion 72*a* of the holder 47, and the lower portion of the holder 47 constitutes a support for the upper portion of the holder 48.

The carriage 40 has an inwardly extending collar 75 which overlies a supporting surface 74 on the upper portion 72 of the holder 46 so that the carriage 40 shares all movements of the holder 46 along the ways 41.

The drive shaft 53 carries a worm 76 in mesh with a worm wheel 77 on the holder 46 so that the latter turns relative to its carriage 40 when the motor 54 is started to rotate the shaft 53 in a clockwise or counterclockwise direction, depending upon whether the carriage 40 is to move upwardly or downwardly. The internal thread of the lower portion 73 and the external thread of the upper portion 72 of the holder 46 are inclined in opposite directions. The holder 46 and the associated carriage 40 are raised if the shaft 53 rotates the holder 46 in a direction to thread the upper portion 72 deeper into the internally threaded portion 78 of the support 49. At the same time, the externally threaded portion 72*a* of the holder 47 is caused to penetrate deeper into the internally threaded lower portion 73 of the holder 46 so that the distance between the carriages 40, 40*a* decreases while the carriage 40 moves upwardly, i.e., nearer to the support 49 for the holder 46. If the direction of rotation of the shaft 53 is changed, the carriage 40 moves away from the support 49 and the carriage 40*a* moves away from the carriage 40.

If the roll 4 is replaced with a larger-diameter roll, the computer 35 transmits a signal which causes the motor 54 to lower the holder 46; at the same time, the carriage 40*a* for the roll 5 descends to assume an optimum position with reference to the lowered carriage 40 for the fresh roll which replaces the roll 4.

An important advantage of the improved calendar is that a larger-diameter intermediate roll can be replaced with a smaller-diameter intermediate roll without extensive or without any lateral shifting of the nip of such intermediate roll with the neighboring rolls. This is due to the fact that the angular displacement of the levers 38 is relatively small because the pivot means 39 for the levers 38 are movable up and down along the respective ways 41. Such mounting of the levers 38 ensures that the centers of the nips 13–16 remain on the line 17, even if the difference between the diameter of the removed intermediate roll and the substitute intermediate roll is very large. The arrangement is preferably such that the bearings 37 are maintained at or close to the levels of the respective carriages 41, i.e., the pivot means 39 are maintained at or close to the levels of the end portions of the respective intermediate rolls. Minor deviations of the levels of pivot means 39 from the levels of the end portions of the respective intermediate rolls are of no consequence because minor pivoting of levers 38 from positions in which their pivot means 39 are at the exact level of the respective bearings 37 entails a minimum of lateral movement of the bearings 37 and, therefore, the centers of the nips of the respective intermediate roll with the neighboring rolls remain in the plane 17.

The configuration of the carriages can be readily selected in such a way that they can move up and down but cannot be tilted relative to the respective ways 41. This contributes to simplicity of the calendar and to stability of the levers 37 at the selected levels.

While it is also possible to support the carriages from below, the provision of suspending devices 45 is preferred at this time because such devices contribute to stability of the carriages in their positions at selected levels in the respective ways 41. It has been found that suspension of carriages 40 in the ways 41 renders it possible to transmit to the frame 1 pronounced stresses with a greater degree of uniformity and predictability than if the carriages were clamped to the respective frame members 2 and/or if the carriages were supported from below. The illustrated suspending devices 45 exhibit the additional advantage that only two holders (46, 47 or 48) must be moved to different levels if the persons in charge wish to gain access to a selected intermediate roll, particularly if an intermediate roll having a first diameter is to be replaced with a roll having a larger or smaller second diameter. The suspending devices 45 constitute improvements and further developments of those which are disclosed in commonly owned German Offenlegungsschrift No. 24 51 230. Certain other types of suspending devices are disclosed in commonly owned German Offenlegungsschrift No. 24 15 836. The purpose of suspending devices in the Offenlegungsschrift No. 24 15 836 is to change the positions of stops serving to determine the extent of vertical movability of bearings which are mounted directly on the frame of the calendar.

An advantage of the extensions 42 and of the compensators 43 thereon is that the extensions 42 share all movements of the respective carriages 40 and, therefore, the positions of the compensators with reference to the carriages remain unchanged. Moreover, the placing of compensators 43 on the extensions 42 of the carriages renders it possible to employ compact compensators whose pistons need not perform long strokes. As will be explained with reference to FIG. 6, each compensator can embody an integral stop which limits the extent of movability of its piston and piston rod and hence the extent of pivotability of the respective lever. This contributes to simplicity and compactness of the entire machine and to versatility of the compensators.

Mounting of the bearings 37*a* for the queen roll 8 and of the supports 49 of suspending devices 45 directly on the respective frame members 2 contributes to compactness (lower height) as well as stability of the entire calendar. Moreover, one can dispense with fluid-operated motors which are used in many calendars to bias the queen roll against the adjacent intermediate roll. The supports 49 of the suspending devices 45 may but need not be mounted on the respective bearings 37*a* for the queen roll.

The feature of providing means for effecting rapid lowering of the king roll in a calendar with a stack of rolls is known from German Pat. No. 28 45 055. An advantage of such rapid lowering is that a defective intermediate roll or an outer roll can be removed and replaced with a fresh roll within a shorter interval of time.

The provision of deformable shells for the outer rolls 7, 8 constitutes an optional feature of the improved calendar. Such outer rolls cooperate with the intermediate rolls (which are mounted in the aforedescribed novel way) and with the compensators 43 to ensure a highly accurate treatment of running webs of paper, plastic or other material, even if the rolls of the stack 3 have different diameters.

Figure 4:
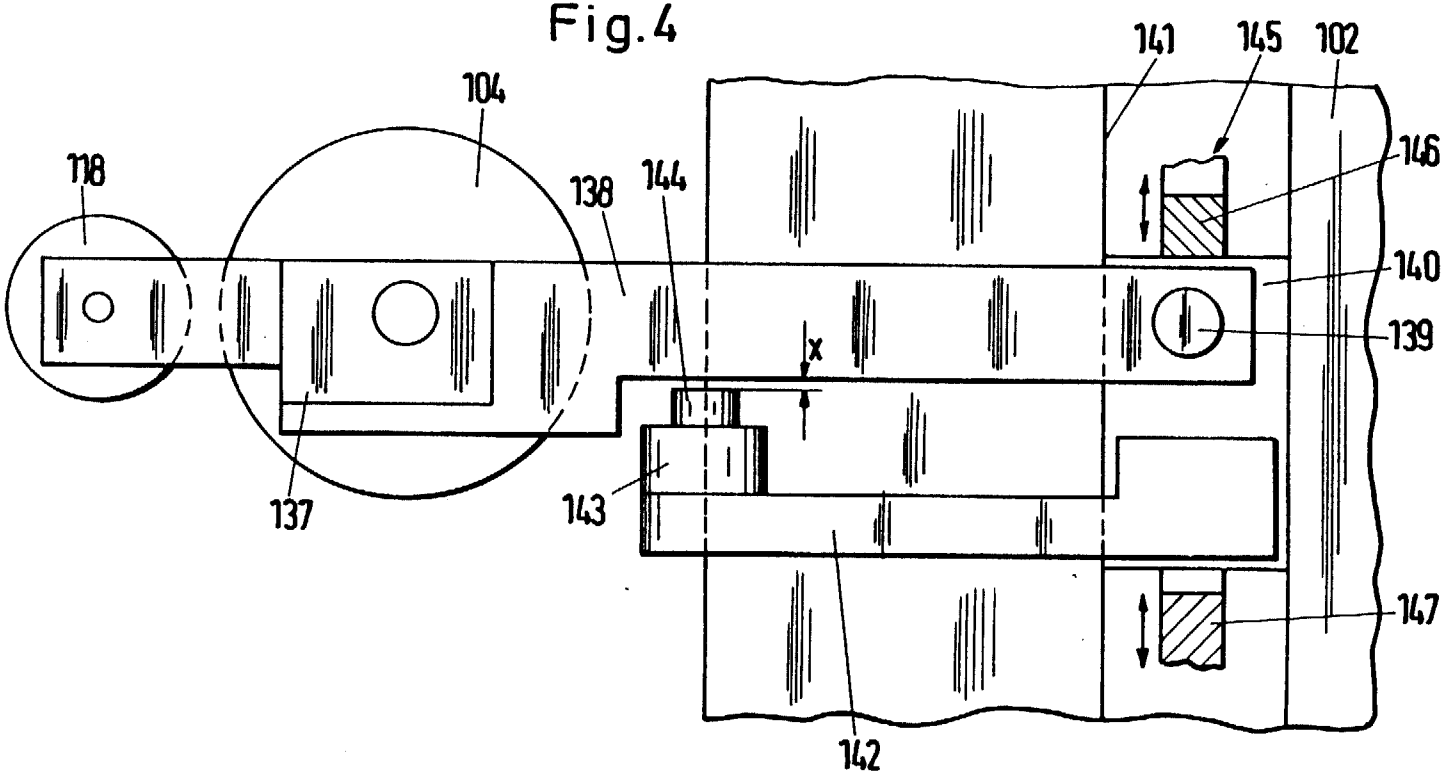
FIG. 4 is a fragmentary side elevational view of a modified calendar wherein the bearings for the end portions of intermediate rolls are mounted on one-armed levers.

FIG. 4 shows a portion of a modified calendar wherein all such parts which are identical with or clearly analogous to the corresponding parts of the calendar of FIGS. 1–3 and 7 are denoted by similar reference characters plus 100. The roll 104 is mounted between two one-armed levers 138 whose pivot means are shown at 139, and the compensators 143 are installed in the regions between the roll 104 and the respective pivot means 139. Therefore, the extensions 142 of the carriages 140 extend toward the roll 104. The piston rod 144 of the illustrated compensator 143 is inoperative, i.e., its upper end portion is spaced apart from the respective lever 138 by a distance x so that the compensator does not exert upon the lever 138 any torque in a direction to counteract the weight of the bearings 137 for the end portions of the roll 104 as well as the weight of the guide roller 118. If the king roll (not shown in FIG. 4) is lowered, the lever 138 of FIG. 4 is free to pivot counterclockwise until its underside reaches and comes to rest on the piston rod 144 of the compensator 143.

Referring to FIG. 6, there are shown two intermediate rolls 104, 105 of a calendar which is similar to that of FIG. 4. Therefore, the parts which are shown in FIG. 6 are denoted by characters similar to those denoting the corresponding parts of the calendar of FIGS. 1 to 3 plus 100. The difference between the structures which are shown in FIGS. 4 and 6 is that the guide rollers on the levers 138 for the bearings 137 on the end portions of the rolls 104, 105 of FIG. 6 are omitted for the sake of clarity and that the levers 138 are shown in their elementary form. The compensator 143 which cooperates with the arm 138 for the roll 104 is a fluid-operated (particularly a hydraulic) motor with a cylinder member 158 on the extension 142 of the respective carriage 140 (not shown in FIG. 6) and a piston member 157 which is reciprocable in and defines with the cylinder member 158 an upper cylinder chamber 164 and a lower cylinder chamber 160. The piston rod 144 is integral with the piston member 157 and abuts the underside of the lever 138 because the lower cylinder chamber 160 contains a pressurized hydraulic fluid. When the piston member 157 descends through the distance x, its underside engages a stop 159 which is an integral part of the compensator 143 and serves as a means for limiting the extent of pivotability of the lever 138 under the weight of the respective bearing 137 for the roll 104.

The chamber 160 can receive pressurized fluid from a pump 131 by way of a pressure reducing valve 163 (which constitutes the source of pressurized fluid for the chamber 160) and a solenoid-operated valve 162 which is connected with the chamber 160 by a conduit 161 having two branches or portions 169, 170. The branch or portion 170 contains a preferably adjustable flow restrictor 171. An outlet of the valve 162 can admit spent fluid from the chamber 160 into the vessel 132. An accumulator 167 is provided to reduce the likelihood of abrupt pressure shocks in the system of conduits between the pump 131 and the chamber 160. The upper chamber 164 is connected with the pump 131 by a conduit 165 which also contains an accumulator 168 and further contains a pressure reducing valve 166 constituting a source of pressurized fluid for the chamber 164. The pressure of fluid which can flow through the valve 166 and into the upper chamber 164 is lower than the pressure of fluid which can flow from the valve 163, through the valve 162 and into the lower chamber 160.

The construction of the compensator **143*a* which cooperates with the illustrated lever for one bearing of the roll 105 is substantially identical with that of the compensator 143 and its parts are denoted by similar reference characters each followed by the letter "a". The main difference between the compensators 143 and 143*a* is that the latter contains a stop which is positioned to permit the piston member of the compensator 143*a*** to descend through a distance 2x.

When the solenoid of the valve 162 is deenergized, the chamber 160 in the cylinder member 158 of the compensator 143 is connected with the vessel 132 so that the accumulator 168 or the pressure reducing valve 166 admits pressurized fluid which acts upon the piston member 157 in the upper chamber 164 and causes the piston member 157 to descend into abutment with the stop 159. The situation is analogous when the solenoid of the valve **162*a* of the compensator 143*a* is deenergized. It will be noted that the pump 131, the pressure reducing valve 166 and the accumulator 168 are common to both compensators 143, 143*a* of FIG. 6. This pump can further supply pressurized fluid to the compensator or compensators for one or more additional intermediate rolls (not shown in FIG. 6**).

The level of the locus of communication between the portion or branch 169 of the conduit 161 and the lower cylinder chamber 160 in the cylinder member 157 of the compensator 143 is selected in such a way that the fluid can leave the chamber 160 via portions or branches 169 and 170 (i.e., primarily via portion or branch 169) during the initial stage of downward movement of the piston member 157 toward abutment with the stop 159. This ensures a rapid lowering of the piston rod 144. After the piston member 157 has covered a certain distance on its way from the position of FIG. 6 toward abutment with the stop 159, its peripheral surface seals the conduit portion 169 from the cylinder chamber 160 so that additional fluid can leave the chamber 160 only by way of the conduit portion 170 and its flow restrictor 171, i.e., the piston member 157 is decelerated and descends gradually toward actual engagement with the stop 159.

If an operator or an automatic monitoring or control unit initiates a sequence of steps preparatory to replacement of the intermediate roll 104 with a fresh roll, the solenoid of the valve 162 is deenergized so that the piston member 157 is caused to descend by the fluid which flows into the upper chamber 164 at a rate determined first by the conduit portion 169 and thereupon by the flow restrictor 171. Thus, the initial stage of separation of the roll 104 from the roll above it takes place rapidly because the piston member 157 does not obstruct the outflow of fluid from the chamber 160 via conduit portion 169. The flow restrictor 171 is set to ensure that the piston member 157 thereupon continues to descend but at a reduced speed so that the piston need strike the stop 159 with a force which could cause damage to the compensator 143. The computer 35 transmits signals to initiate a lowering of the roll 104 simultaneously with transmission of an appropriate signal to the regulator 33 of FIG. 1 so that the regulator 33 causes the valves 30 to initiate a lowering of the king roll simultaneously with a lowering of the intermediate roll 104.

The conduit 165, the associated accumulator 168 and the pressure reducing valve 166 constitute an optional but desirable feature of the improved calendar. The function of such parts is to promote the downward movement of the piston member 157 at the speed which is determined by the ability of fluid to leave the chamber 160 via conduit portion 169 and/or 170. Moreover, fluid which fills the chamber 164 ensures that the level of the piston member 157 cannot be changed accidentally when the calendar is in use.

The accumulators **167, 167*a*, 168 also constitute optional features of the calendar. They are desirable because of their ability to counteract vibrations which often tend to develop in a calendar, especially because certain parts (such as rolls) are running out of balance. It often suffices to provide accumulators only for the upper or only for the lower chambers of the compensators 143, 143*a***.

An advantage of simultaneous actuation of valves 30 (FIG. 1) and one or more valves **162, 162*a* is that a selected intermediate roll which necessitates replacement can be moved away from the neighboring rolls while the motors 25 rapidly lower the king roll 7** so as to even further shorten the interval of time which is required for such replacement.

Figure 5:
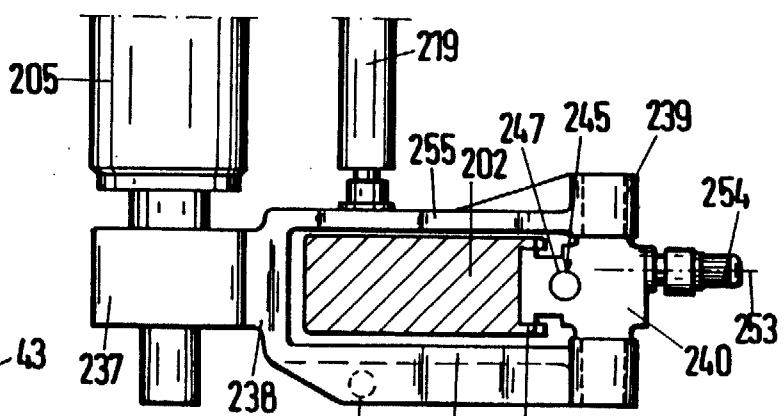
FIG. 5 is a fragmentary horizontal sectional view similar to that of FIG. 3 but showing a portion of a third calendar wherein the levers for the bearings at the ends of the intermediate rolls have bifurcated portions which surround the respective frame members.

FIG. 5 shows a portion of a third calendar wherein all such parts which are identical with or clearly analogous to the corresponding parts of the calendar of FIGS. 1 to 3 are denoted by similar reference characters plus 200. The illustrated lever 238 is a one-armed lever which carries a bearing 237 for the respective end portion of the intermediate roll 205 at its free end and the other end of which is rigid or integral with the pivot means 239 having two portions flanking the carriage 240 which is reciprocable along vertical ways 241 provided at that side of the frame member 202 which faces away from the roll 205 and guide roller 219. The latter is mounted on one (255) of two prongs 255, 256 of the bifurcated portion of the lever 238 between the bearing 237 and the carriage 240. The prongs 255, 256 flank the frame member 202. The prong 256 of the bifurcated portion of the lever 238 cooperates with the compensator 243 which is mounted on an extension of the carriage 240. The holder 247 for the carriage 240 forms part of the suspending device 245 and its angular position can be changed by a reversible stepping motor 254 through the medium of a shaft 253. This results in a lifting or lowering of the carriage 240 and pivot means 239 for the lever 238.

An advantage of the embodiment which is shown in FIG. 5 is that the lever 238 is less likely to impart to the corresponding carriage 240 a tilting movement in the respective ways 241. This will be readily appreciated since the prongs 255, 256 of the illustrated lever 238 straddle the frame member 202 and each such prong is mounted on a discrete part of the pivot means 239. This reduces the tendency of the carriage 240 to jam in its ways 241.

The improved calendar is susceptible of many additional modifications. For example, the calendar can employ a queen roll (8) which is vertically movably mounted in the frame. Furthermore, the stack of rolls can include a fixedly mounted center roll in a manner as shown in FIG. 1 of U.S. Pat. No. 3,016,819 to Hornbostel, a first set of intermediate rolls between the center roll and the queen roll, and a second set of intermediate rolls between the center roll and the king roll. Still further, the number of intermediate rolls can be reduced to less or increased to more than three. The illustrated level monitoring devices 34, 52 can be replaced with other types of devices which are capable of indicating the positions of the bearings for the king roll and/or the positions of carriages in their ways. At least some of the hydraulic motors, such as the motors of the compensators, can be replaced with pneumatic motors.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A calendar comprising a frame; a stack of rolls in said frame, said stack including two outer rolls and at least one intermediate roll, said outer rolls including a first roll at a level above and a second roll at a level below said one intermediate roll and said rolls having axes disposed in or close to a common plane, said intermediate roll having coaxial first and second end portions; first and second bearings for the respective end portions of said intermediate roll; first and second levers for the respective bearings; and means for movably mounting said levers in said frame, including first and second ways provided in said frame, first and second carriages reciprocable along the respective ways, first and second pivot means angularly movably connecting said first and second levers to the respective carriages, and means for moving said carriages along the respective ways, said pivot means having a common axis which is parallel to the axis of said intermediate roll and said bearings being located at or close to the levels of said carriages, said ways extending transversely of said common axis and of said levers.

2. The calendar of claim 1, wherein said common axis is substantially horizontal and said ways are substantially vertical, said moving means including means for locating each of said carriages at any one of a plurality of different levels relative to the respective ways.

3. The calendar of claim 1, wherein said frame includes first and second frame members and said ways include parallel first and second guides provided in the respective frame members, said carriages including portions non-rotatably and reciprocably installed in the respective guides.

4. The calendar of claim 1 wherein said frame includes parallel first and second frame members and said levers have bifurcated portions flanking the respective frame members, each of said frame members having a side facing away from the respective bearing and said ways being provided at said sides of the respective frame members.

5. The calendar of claim 1, wherein said ways are substantially vertical and said moving means including means for maintaining said carriages in suspended positions.

6. The calendar of claim 1, further comprising means for limiting the extent of pivotability of said levers with reference to the respective carriages.

7. The calendar of claim 6, wherein said ways are substantially vertical and each of said levers has a first portion supporting the respective bearing and a second portion adjacent a portion of the respective carriage, said limiting means comprising compensator means disposed between said second portions and said portions of the respective carriages.

8. The calendar of claim 7, wherein said bearings and said one intermediate roll tend to pivot said levers about said common axis in a predetermined direction and said compensating means includes means for applying to said second portions torque acting upon said levers counter to said predetermined direction.

9. The calendar of claim 1, wherein said rolls define at least two nips for a running web of flexible material and further comprising a web guide on said levers.

10. The calendar of claim 1, wherein said outer rolls include a first outer roll at a level above and a second outer roll at a level below said intermediate roll, said second outer roll having coaxial end portions and further comprising bearings for the end portions of said second outer roll and fluid-operated motors for moving the bearings for the end portions of said second outer roll up and down, said motors having means for rapidly lowering the respective bearings so as to rapidly increase the distance between the two outer rolls.

11. The calendar of claim 1, wherein at leas tone of said outer rolls includes a carrier, a deformable shell rotatably surrounding said carrier, and means for selectively deforming portions of said shell.

12. The calendar of claim 1, wherein said moving means includes motor means.

13. A calendar comprising a frame; a stack of rolls in said frame, said stack including two outer rolls and at least one intermediate roll, said one intermediate roll having coaxial first and second end portions; first and second bearings for the respective end portions of said one intermediate roll; first and second levers for the respective bearings; and means for movably mounting said levers in said frame, including first and second substantially vertical ways provided in said frame, first and second carriages reciprocable along the respective ways, first and second pivot means angularly movably connecting said first and second levers to the respective carriages, and means for moving said carriages along the respective ways, said moving means including means for maintaining said carriages in suspended positions including a support for each of said carriages, a holder connected with each carriage and substantially vertically movably coupled to the respective support, and means for moving said holders with reference to the respective supports.

14. The calendar of claim 13, wherein said stack comprises an additional intermediate roll beneath said one intermediate roll and further comprising bearings, levers and mounting means for said additional intermediate roll, each holder for the carriages for the levers for the bearings for the end portions of said one intermediate roll including a first threaded portion mating with the respective support and a second threaded portion mating with the first threaded portion of the corresponding holder for a carriage for a lever for a bearing for an end portion of said additional roll, said means for moving said holders including means for rotating the holders for said one intermediate roll so as to raise or lower said one intermediate roll relative to the supports as well as relative to said additional intermediate roll.

15. A calendar comprising a frame; a stack of rolls in said frame, said stack including two outer rolls and at least one intermediate roll, said intermediate roll having coaxial first and second end portions; first and second bearings for the respective end portions of said intermediate roll; first and second levers for the respective bearings; means for movably mounting said levers in said frame, including first and second ways provided in said frame, first and second carriages reciprocable along the respective ways, first and second pivot means angularly movably connecting said first and second levers to the respective carriages, and means for moving said carriages along the respective ways, said pivot means having a common axis which is parallel to the axis of said intermediate roll and said ways extending transversely of said common axis; and means for limiting the extent of pivotability of said levers with reference to the respective carriages, comprising a portion of one of said levers and a stop provided on the respective carriage and located in the path of movement of said portion of said one lever.

16. A calendar comprising a frame; a stack of rolls in said frame, said stack including two outer rolls and at least one intermediate roll, said intermediate roll having coaxial first and second end portions; first and second bearings for the respective end portions of said intermediate roll; first and second levers for the respective bearings; means for movably mounting said levers in said frame, including substantially vertical first and second ways provided in said frame, first and second carriages reciprocable along the respective ways, each of said carriages having an extension, first and second pivot means angularly movably connecting said first and second levers to the respective carriages, and means for moving said carriages along the respective ways, said pivot means having a common axis which is parallel to the axis of said intermediate roll and said ways extending transversely of said common axis, each of said levers having a first portion supporting the respective bearing and a second portion adjacent the respective extension; and compensator means disposed between said second portions of said levers and the respective extensions, said bearings and said intermediate roll tending to pivot said levers about said common axis in a predetermined direction and said compensating means including means for applying to said second portions of said levers torque acting upon said levers counter to said predetermined direction.

17. The calendar of claim 16, wherein at least one of said compensator means includes means for limiting the extent of pivotability of said levers in said predetermined direction.

18. The calendar of claim 16, wherein at least one of said compensating means comprises a fluid-operated motor.

19. The calendar of claim 18, wherein said motor includes a cylinder member, a piston member reciprocable in and defining with said cylinder member a chamber, a source of pressurized fluid, a vessel for spent fluid, and valve means for selectively connecting said chamber with said source or with said vessel.

20. The calendar of claim 19, wherein said motor further comprises a first and a second conduit portion each connecting said chamber with said valve means and flow restrictor means provided in one of said conduit portions, one of said members being movable relative to the other of said members to thereby cause expulsion of fluid from said chamber by said piston member, said one member being movable between a plurality of first positions in each of which said piston member permits the fluid to leave said chamber by way of the other of said conduit portions and a plurality of second positions in which said piston member blocks the flow of fluid from the chamber by way of said other conduit portion but allows fluid to leave said chamber by way of said one conduit portion and said flow restrictor means.

21. The calendar of claim 19, wherein said cylinder member and said piston member further define a second chamber and said motor further comprises a second source of pressurized fluid and means for connecting said second source with said second chamber.

22. The calendar of claim 21, wherein the pressure of fluid in said second source is lower than in said first named source.

23. The calendar of claim 2, further comprising accumulator means for pressurized fluid connected with at least one of said sources.

24. A calendar comprising a frame; a stack of rolls in said frame, said stack including two outer rolls and at least one intermediate roll, and said intermediate roll having coaxial first and second end portions; one of said outer rolls being located above and the other of said outer rolls being located below said intermediate roll, said one outer roll having end portions; bearings rotatably mounting the end portions of the one outer roll and affixed to said frame; first and second bearings for the respective end portions of said intermediate roll; first and second levers for the first and second bearings, respectively; and means for movably mounting said levers in said frame, including first and second ways provided in said frame, first and second carriages reciprocable along the respective ways, first and second pivot means angularly movably connecting said first and second levers to the respective carriages, means for moving said carriages along the respective ways, and means for suspending the carriages for said intermediate roll in said frame, said suspending means including supports connected to said frame, said pivot means having a common axis which is parallel to the axis of said intermediate roll and said ways extending transversely of said common axis.

25. A calendar comprising a frame; a stack of rolls in said frame, said stack including two outer rolls and at least one intermediate roll, said outer rolls including a first outer roll at a level above and a second outer roll at a level below said intermediate roll, said second outer roll having coaxial end portions and said intermediate roll having coaxial first and second end portions; bearings for the end portions of said second outer roll; fluid-operated motors for moving said bearings up and down, said motors having means for rapidly lowering the respective bearings so as to rapidly increase the distance between the two outer rolls, said means for rapidly lowering including first valve means; first and second bearings for the respective end portions of said intermediate roll; first and second levers for the first and second bearings, respectively; means for movably mounting said levers in said frame, including first and second ways provided in said frame, first and second carriages reciprocable along the respective ways, first and second pivot means angularly movably connecting said first and second levers to the respective carriages; and means for moving said carriages along the respective ways, said pivot means having a common axis which is parallel to the axis of said intermediate roll and said ways extending transversely of said common axis; means for applying to said levers torque in directions to counteract the tendency of such levers to turn under the weight of the bearings for said intermediate roll, said torque applying means including at least one additional fluid-operated motor and second valve means for regulating the flow of fluid to and from said additional motor; and means for simultaneously actuating said first and second valve means.

* * * * *